United States Patent [19]

Bouligny, Jr. et al.

[11] Patent Number: 4,989,909

[45] Date of Patent: Feb. 5, 1991

[54] FRICTION GRIP FOR TUBULAR GOODS

[75] Inventors: Vernon J. Bouligny, Jr., New Iberia; Charles M. Webre, Lafayette, both of La.

[73] Assignee: Franks Casing Crew and Rental tools, Inc., Lafayette, La.

[21] Appl. No.: 394,949

[22] Filed: Aug. 17, 1989

[51] Int. Cl.[5] ..... B66C 1/46

[52] U.S. Cl. ..... 294/119.3; 269/22; 188/67

[58] Field of Search ..... 294/119.3, 98.1, 63.2, 294/119.2; 269/22; 279/2 A; 285/97; 403/5; 188/67; 74/162, 164

[56] References Cited

U.S. PATENT DOCUMENTS

| | | | |
|---|---|---|---|
| 2,992,023 | 7/1961 | Yantis | 285/97 |
| 3,542,354 | 11/1970 | Fitzpatrick | 294/119.3 X |
| 4,403,801 | 9/1983 | Huff et al. | 294/119.3 |
| 4,687,189 | 8/1987 | Stoll et al. | 269/22 |
| 4,712,284 | 12/1987 | Coyle, Sr. et al. | 269/23 X |
| 4,714,289 | 12/1987 | Arzenti et al. | 294/119.3 |

FOREIGN PATENT DOCUMENTS

| | | | |
|---|---|---|---|
| 2429957 | 2/1980 | France | 285/97 |

*Primary Examiner*—Margaret A. Focarino
*Assistant Examiner*—Dean J. Kramer
*Attorney, Agent, or Firm*—Joseph L. Lemoine, Jr.

[57] ABSTRACT

An apparatus for gripping tubular members about their outer diameter without causing surface damage or structural deformation to the tubular members, so that they may be axially rotated or secured against axial rotation. A generally cylindrical internal sleeve is contained within a molded flexible liner. One side of the internal sleeve is releasably attached to the flexible liner, forming an annular bladder-like structure within the flexible liner. Introduction of pressure into the bladder-like structure causes the flexible liner to inflate radially inward and thereby grip tubular workpieces within the friction grip. Axial splines on the releasable side of internal sleeve interfit mate with corresponding splines of the molded flexible liner, thereby evenly distribute torque forces throughout the flexible liner rather than such torque forces being concentrated at only the edges of the flexible liner. Movable anti-extrusion rings at the axial edges of the flexible linear prevent deformation of the liner into the annular space between the outer sleeve of the friction grip, and also prevent wear between the axial edges of the liner and the edges of the outer sleeve. An additional, non-rigid sleeve, or coating, of friction enhancing material may be placed on the inner face of the flexible liner to increase the frictional characteristics of the grip and/or increase service life of the surface of the flexible liner. Instead of being made of one annular section, the friction grip may be made of two, or more, hingedly connected sections so as to allow the gripper to be attached at the midpoint of tubular workpieces without having to slide it over one end of workpiece.

16 Claims, 3 Drawing Sheets

FRICTION GRIP FOR TUBULAR GOODS

BACKGROUND OF THE INVENTION

1. Field of the Invention

The invention relates to devices for gripping tubular members, such as pipes or shafts, so that said members may be rotated axially, or secured against axial rotation. More particularly the invention relates to devices for gripping tubulars, and transmitting substantial torque to the tubular, without use of biting teeth or other hardened gripping surfaces which may cause surface or structural damage to the pipe.

2. Description of Prior Art

In virtually every industrial field there is at least some requirement for gripping tubulars so that they may be axially rotated or secured against rotation. Perhaps the best known requirement for gripping and axially rotating (and securing) tubulars is the assembly and disassembly of threaded connections. Such assembly and disassembly is extremely common in the earth boring industry, particularly that involving oil and gas exploration, where a single well can involve strings of pipe thousands of feet long, which must be assembled and disassembled several times at the surface on a piece-by-piece basis.

Because of the need to repetitively assemble and disassemble threaded connections, particularly in the oil field, various devices, generally referred to as tongs, have been developed to facilitate that task. One tong, generally called the power tong, rotates a first threaded member axially, while another tong, generally called the back up tong, secures a second, mating member against rotation.

Pipe used in the earth boring industry, particularly in the oil and gas field, is frequently subject to severe service. As deeper wells are drilled, the weight of the pipe string increases, as does the internal and external pressures the pipe must bear. The minerals produced are sometimes highly corrosive. Consequently, in some applications, even minor damage to the pipe can lead to premature failure of the pipe in the well bore. Even minor scoring or localized work hardening of the surface of the pipe can cause stress build-ups which can cause the tubular to rupture under internal pressure or crack during assembly or disassembly. Even minor damage to protective coatings can result in premature failure of the tubular due to corrosion. Considering the substantial cost of certain tubular goods, and the cost, time, and danger associated with pipe failure in a well bore, it is highly desirable to avoid all pipe damage during assembly and disassembly of threaded connections.

Various gripping devices, for tubular goods, are known in prior art, but generally these rely on teeth, which bite into the surface of the pipe, to obtain sufficient grip to impart the high torque loads required to create a tight, leak proof connection, for example see U.S. Pat. Nos. 3,545,313, 3,796,418 and 3,912,473.

Mosing U.S. Pat. No. 4,372,026 discloses an improved tong design, utilizing smooth cam surfaces to frictionally grip pipe. While this design represents a significant improvement over use of biting teeth, in very high torque applications, or where relatively soft pipes are used, even the smooth gripping surfaces, applied at discrete, small areas around the pipe's circumference, with high radially inward forces, could cause surface or structural damage to the tubular.

Coyle U.S. Pat. No. 4,712,284 discloses tongs utilizing several discrete, relatively rigid, smooth faced jaws, of relatively soft material to frictionally grip pipe. However, this device does not entirely avoid the underlying problem, which is application of high radially inward forces at discrete areas around the circumference of the pipe. Application of such forces can cause surface or structural damage when high torque or soft pipe is used. Coyle, in fact mentions its preference for serrated, rather than smooth, gripping surfaces when some surface damage to the pipe, such as is said to be the case with fiberglass pipe, can be tolerated. When such serrated jaws are used this device is not truly a pure friction grip device, but rather relies at least partially on biting of the pipe surface to obtain sufficient grip to impart the high torque loads required for sufficient tightening of threaded connection.

These patents do not disclose the present invention. Hitherto, prior art means for gripping tubular members has been by use of teeth, or use of frictional surfaces engaging the pipe in relatively small, discrete areas; or by combination of both means. (Both means have certain disadvantages. Teeth score the pipe and/or pipe coating. Smooth, rigid frictional engagement surfaces in small, discrete areas necessitate the use of high radial contact force per unit of contact area, which can lead to deformation of the cross-sectional area of the pipe and/or localized work hardening of the contact area.

The invention disclosed herein represents a significant improvement over prior art in that it distributes the radial forces, which are required to achieve high torque loads, more uniformly around the tubular's entire circumference and over a substantial axial length of the tubular. By distributing the radial force uniformly over a large contact area the frictional (tangential) forces required for satisfactory tightening of the tubular may be achieved with lowered gripping (radial) forces per unit of contact area. Further, the flexible nature of the gripping surface described herein automatically compensates for minor manufacturing irregularities of the tubular, such as lack of perfect roundness, surface distortions, etc.

OBJECTS OF THE INVENTION

The general object of this invention is to provide a new and improved means to grip tubular goods (including solid, cylindrical goods) without causing surface damage or structural deformation to said goods.

More particularly, one object of the invention is to provide an improved device for gripping tubular goods by means of frictional engagement only.

A further object of the invention is to distribute the radial forces required for adequate gripping of the tubular member more uniformly about the entire circumference of the tubular.

Yet another object of the invention is to provide a grip with a flexible gripping surface to compensate for manufacturing irregularities of tubulars.

Yet a further object of the invention is to provide a device with lowered gripping (radial) forces per unit of contact area.

SUMMARY OF THE INVENTION

The improved frictional grip, for gripping tubular goods, without causing surface or structural damage to said goods, is characterized by a generally cylindrical outer sleeve; a flexible liner disposed inside of the outer sleeve; an annular bladder-like structure disposed within the flexible liner; a splined internal sleeve adjacent to the bladder-like structure for distribution of rotary forces throughout the bladder-like structure; a means for introducing fluid pressure into the bladder-like structure; anti-extrusion rings to prevent deformation of the liner into the annular space between the outer sleeve and a tubular member within the grip; and, an inner lining or coating of friction enhancing material.

The improved frictional grip is installed around the circumference of the tubular to be gripped, then a controlled amount of fluid pressure is introduced into the bladder-like structure. Initial introduction of pressure causes the flexible liner to expand radially inward and drive the friction sleeve into contact with a tubular member. Further introduction of fluid pressure into the bladder causes the friction sleeve to thrust against the tubular with increased radial pressure. By controlling the amount of fluid pressure introduced into the bladder the lowest amount of radial force necessary to produce adequate torquing (frictional force) can be selected.

Once the frictional grip has been engaged with fluid pressure rotary torque is applied to the outer sleeve by various conventional means (tongs, pipe wrenches, etc.). The torque applied to the outer sleeve is transmitted through the outer sleeve and flexible liner to the gripped pipe. Interlocking splines, between the internal sleeve and the flexible liner, evenly distribute the rotary torque throughout the flexible liner to provide even application of forces to the workpiece and prevent damage to the flexible liner.

When the tubular workpiece has been sufficiently tightened, external torque is removed from the frictional grip and fluid pressure in the bladder-like structure released. Upon release of the fluid pressure the flexible liner elastically retracts from contact with the workpiece and the friction grip is removed. The friction grip may be made in two (or more) hingedly connected sections to facilitate installation on, or removal from, tubular goods.

DESCRIPTION OF THE PREFERRED EMBODIMENT

The preferred embodiment of the present invention has six components, those being: a rigid, generally cylindrical outer sleeve; a flexible lining securely attached to the inside of the outer sleeve; a splined, generally cylindrical, internal sleeve disposed within the flexible liner; means for introduction and withdrawal of fluid pressure into a bladder-like structure formed between the radially inward face of the internal sleeve and the flexible liner; two, generally annular, anti-extrusion rings to prevent deformation of the flexible liner into the space between the outer housing and a tubular member; and, a frictional sleeve or coating attached to the radially inward face of the flexible liner.

Figure 1:
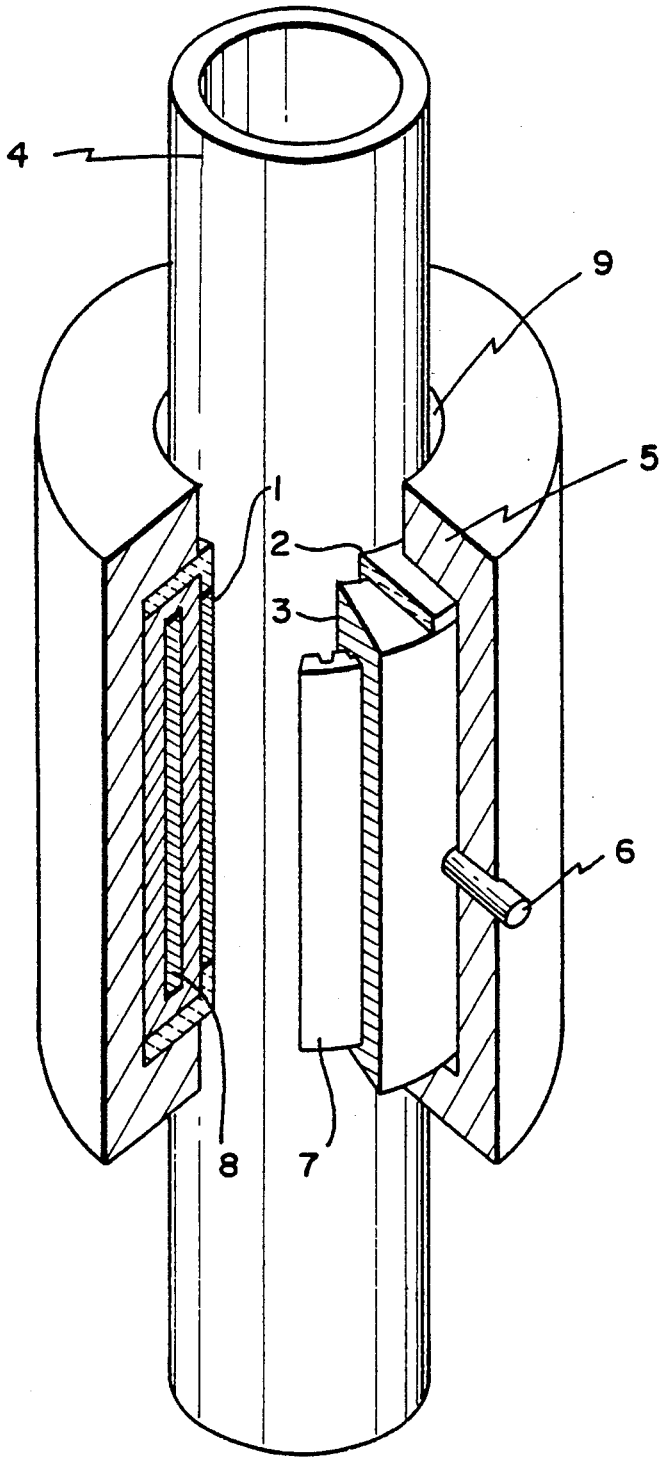
FIG. 1 is a schematical isometric partial sectional view of the improved friction grip.
Figure 2:
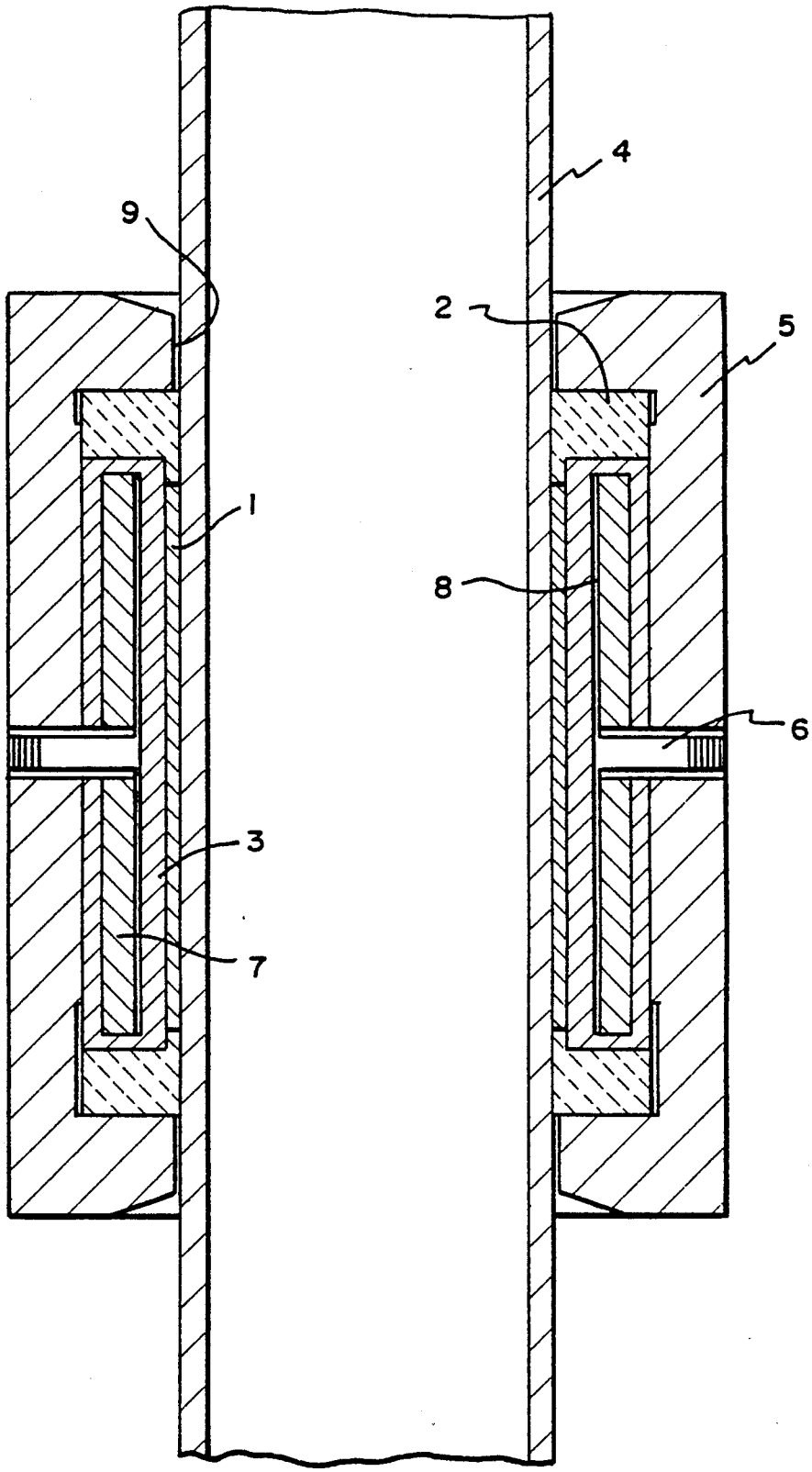
FIG. 2 is a schematical cross-sectional view of the improved friction grip from overhead.
Figure 3:
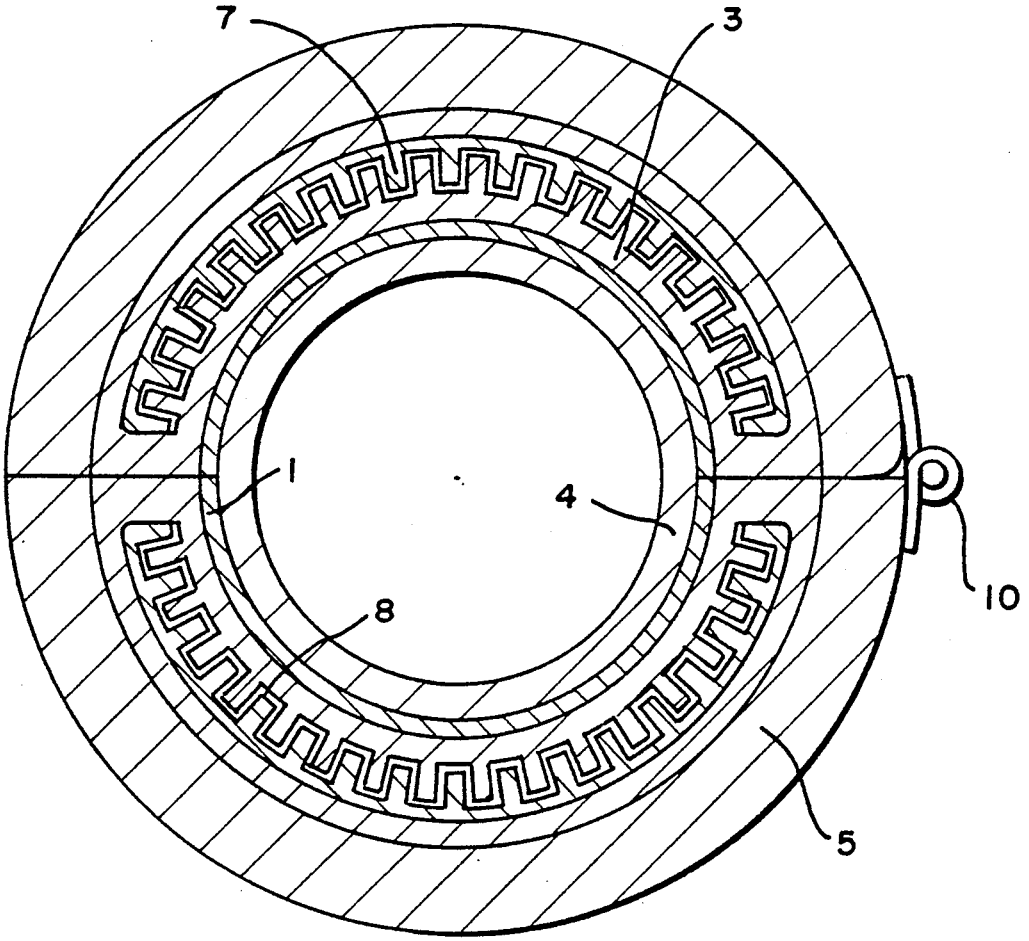
FIG. 3 is a schematical longitudinal cross-section of the improved friction grip.

With reference to FIG. 1, FIG. 2 and FIG. 3, the first major component of the improved friction grip is the rigid outer sleeve, 5. The outer sleeve, 5, is generally cylindrical with a central axial bore slightly larger than the outer diameter of tubular members to be gripped. An annular cavity extends radially outward from the central bore, which is of sufficient depth to accommodate a flexible liner, 3, and inner friction sleeve, 1. In the preferred embodiment the outer sleeve is comprised of two half cylinders, connected by hinge, 10, to facilitate placement around and removal from tubular members, however the friction grip may be made of an integral cylinder, or any convenient plurality of hingedly connected cylindrical sections comprising a complete cylinder.

With further reference to FIG. 1, FIG. 2 and FIG. 3, the second major component of the improved friction grip is the flexible liner, 3. The flexible liner, 3, is securely attached to the radially inward face of the outer sleeve, 5. The flexible liner, 3, is made of durable, elastic material which is somewhat flexible, yet resilient to compressive and shear forces. We have found certain probable high density polyurethane compounds which work well, but a wide variety of other suitable materials could also be used. The liner material may be reinforced with suitable fibers for increased service life.

Further, referring to FIG. 1, FIG. 2 and FIG. 3, the third major component of the improved friction grip is the internal sleeve, 7. The internal sleeve, 7, is generally cylindrical in shape, and is disposed within the flexible liner, 3, approximately equidistant between the outer sleeve, 5, and friction sleeve, 1. In the preferred embodiment the radially outward face of the internal sleeve, 7, is securely attached to the flexible liner, 3, whereas the radially inward face of the internal sleeve, 7, is releasable from the flexible liner, 3. In practice we accomplish this by using material for the flexible liner, 3, which is pourable before curing. The radially inward face of the internal sleeve, 7, is coated with a suitable releasing agent before pouring the flexible liner, 3, around it. Therefore after curing of the flexible liner, 3, the radially inward face of the internal sleeve remains unattached to the liner. By leaving one face of the internal sleeve, 7, not attached to the flexible liner, 3, an annular, inflatable, bladder-like structure, 8, is formed on one side of the internal sleeve.

In the preferred embodiment the radially inward face of the internal sleeve, 7, has axial splines which mate with corresponding splines on the adjacent (radially outward) face of the flexible liner 3. The depth of the splines must be greater than the radially inward movement of the flexible liner, 3, so that at maximum inflation of the bladder the mating splines remain partially engaged. These mating axial splines provide widely distributed, mechanical interference between the internal sleeve, 7, and the flexible liner, 3, in a radial (tangential) direction, so as to more uniformly distribute tangential forces throughout the flexible liner, 3, during torquing of the tubular member, 4. While we have found axial splines of rectangular cross-sectional shape work well, splines of other cross-section shapes, or numerous other type of structures (such as radial ridges, pins, etc.) which allow only radial movement between the flexible liner and internal sleeve (but restrict tangential displacement) could also be used.

The next component of the friction grip is a means for introduction and withdrawal of fluid pressure into the bladder-like structure, 8. In the preferred embodiment this is accomplished by means of a tube, 6, which sealingly penetrates the outer housing, 5, and internal sleeve, 7. When pressure, usually hydraulic, is introduced into the bladder-like structure, 8, through tube, 6, said pressure causes the bladder-like structure, 8, to expand. Since outward expansion of the liner is prevented by the rigid outer sleeve, 5, the flexible liner, 3, deforms radially inward, pushing the friction sleeve, 1, into contact with a tubular member, 4, within the device. By controlling the amount of fluid pressure within the bladder-like structure, 8, the friction sleeve, 1, can be forced against the tubular member, 4, with any desired amount of radial force (which is generally proportional to the torque which the device can transfer).

The next component of the grip is anti-extrusion rings, 2. In the preferred embodiment annular anti-extrusion rings, 2, are disposed at the axial extremes of the flexible liner, 3, to prevent deformation of the flexible liner, 3, into the annular space, 9, during inflation of the bladder-like structure, 8. We have found that such deformation, if allowed, tends to reduce the service life of the flexible liner, 3. In the preferred embodiment the anti-extrusion rings, 2, are made of a rigid material which has a characteristically low coefficient of friction, such as nylon. A further advantage using the anti-extrusion rings, 2, is prevention of wear between the flexible liner, 3, and outer sleeve, 5. As the flexible liner, 3, deforms radially inward in response to hydraulic pressure, the anti-extrusion rings, 2, also slide radially inward, against the outer sleeve, 5, thereby preventing frictional wear between the flexible liner, 3, and the outer sleeve, 5. The anti-extrusion rings, 2, have a small lip projecting slightly over the radially inward face of the flexible liner, 3, to assure movement with, rather than against, the flexible liner.

With reference to FIG. 1, FIG. 2 and FIG. 3 the last major component of the improved friction grip is an optional inner friction sleeve (or coating), 1. The friction sleeve (or coating), 1, is made of a flexible material having a characteristically high coefficient of friction and of high durability. We have found that a thin sleeve of commercially available, metal reinforced, fiberglass based brake material works well, but numerous other materials could be used. The friction sleeve (or coating), 1, is attached to the radial inward face of the flexible liner, 3, and is therefore disposed between the flexible liner, 3, and a tubular member, 4, to be gripped. The friction sleeve (or coating), 1, is used to increase the coefficient of friction between gripping surface of the invention and the tubular member, 4, when the inherent frictional characteristics of the flexible liner material is insufficient to generate adequate torque at acceptable radial pressures, or simply to increase service life of the flexible liner, 3. We have found it preferable to attach the friction sleeve, 1, in such a manner that it is easily removable, so that the sleeve alone may be replaced when worn.

The friction grip is simple and easy to use. It may be applied on the tubular member as a separate apparatus and then conventional driving (or securing) devices such as wrenches or tongs used to rotate (or secure) the outer housing. Alternatively, the friction grip may be integrally installed on a conventional driving (or securing) device such as tongs, for automatic use therewith.

To activate the grip, fluid pressure is applied into the bladder-like structure, 8. The flexible liner, 3, deforms radially inwards until it contacts the tubular, 4. Further increasing the pressure within the bladder causes increasing radially inward force ("grip") to be applied to the tubular, 4. Once the bladder is inflated to the desired pressure, said pressure is maintained either by continuous pressure supply or by use of a valve to retain the pressure within. Generally the lowest fluid pressure is applied which is required to produce that amount of gripping force which is necessary to prevent the grip from slipping when the desired torque is applied to the pipe. The fluid pressure required to produce a certain torque is roughly proportional to radial thrust applied to the tubular. Due to the large contact area between the grip and the tubular, and the uniformity which radial pressure is applied around the tubular's entire circumference, reduced radial forces per unit of contact area are capable of generating large frictional forces (rotary torque) without risk of radial collapse or risk of surface damage to the tubular. If necessary, the friction grip may be extended axially, as desired, to distribute the radial-compression forces required to generate a particular torque over an even larger area. It is, therefore, possible with this invention to avoid excessive clamping (radially inward) pressures that could cause surface or structural damage to tubular members, even with soft pipes or their coatings.

Various other uses and modifications of the present invention will occur to those skilled in the art. For example, the friction grip could easily be used as a coupling for rotary drive shafts. By way of further example the friction grip could be modified to operate as a hydraulic brake for shafts, wheels, cylinders or almost any cylindrical shaped object.

Accordingly the foregoing description should be regarded as only illustrative of the invention, whose full scope is measured by the following claims.

We claim:

1. An improved friction grip, for gripping a cylindrical member about its outer diameter without causing surface or structural damage to said cylindrical member, for use in conjunction with means to axially rotate said cylindrical member, or secure said member against axial rotation, comprising:

(a) a rigid, generally cylindrical outer sleeve having an axial bore slightly larger than the workpiece to be gripped, and having a somewhat larger annular shaped central cavity therein;

(b) an elastic flexible liner securely attached to the radially inward face of the annular shaped cavity of the outer sleeve;

(c) a generally cylindrical internal sleeve, disposed within said flexible liner, said internal sleeve having one side securely attached to said flexible liner, and its opposite side forming an internal annular bladder-like structure by being releasable from the flexible liner said releasable side of internal sleeve having a mechanical structure which interfittingly mates with a corresponding structure on the adjacent side of the flexible liner in such a manner that the flexible liner may move radially inward in response to fluid pressure between the internal sleeve and flexible liner but which precludes relative tangential movement between the internal sleeve and flexible liner thereby causing torque forces to be distributed substantially uniformly throughout the flexible liner; and, (d) means for introduction of or withdrawal of a desired amount of fluid pressure into or from the annular bladder, so as to cause a desired amount of radially inward force to act on a workpiece within the improved friction grip.

2. The apparatus of claim 1, further comprising:

(e) a generally cylindrical friction sleeve or coating, made of durable, non-rigid material with a characteristically high coefficient of friction, which said sleeve is disposed on the radially inward face of said flexible liner:

3. The apparatus of claim 1, further comprising:

(e) generally annular anti-extrusion rings, made of durable, rigid having a low coefficient of friction material, said anti-extrusion rings being slidably disposed between the axially outward edge of the flexible liner and the axially inward edge of the annular cavity within the outer sleeve, and said anti-extrusion rings further having a radial lip which extends over a minority of the radially inward face of the flexible liner:

4. The apparatus of claim 2, further comprising:

(f) generally annular anti-extrusion rings, made of durable, rigid material, said anti-extrusion rings being slidably disposed between the axially outward edge of the flexible liner and the axially inward edge of the annular cavity within the outer sleeve, and said anti-extrusion rings further having a radial lip which extends over a minority of the radially inward face of the flexible liner.

5. The apparatus of claim 1, wherein said outer sleeve, flexible liner, and internal sleeve are comprised of an equal plurality of hingedly connected axial sections of a cylinder comprising a complete cylinder, each cylindrical section being provided with means for introduction or withdrawal of a desired amount of fluid pressure into or from the plurality of bladder-like structures formed.

6. The apparatus of claim 2, wherein said outer sleeve, flexible liner, internal sleeve and friction sleeve are comprised of an equal plurality of hingedly connected axial sections of a cylinder consisting of a whole cylinder, each being provided with means for introduction or withdrawal of a desired amount of fluid pressure into or from the plurality of bladder-like structures formed.

7. The apparatus of claim 3, wherein said outer sleeve, flexible liner, internal sleeve and anti-extrusion rings are comprised of an equal plurality of hingedly connected axial sections of a cylinder consisting of a whole cylinder, each cylindrical section being provided with means for introduction or withdrawal of a desired amount of fluid pressure into or from the plurality of bladder-like structures formed.

8. The apparatus of claim 4, wherein said outer sleeve, flexible liner, internal sleeve, friction sleeve and anti-extrusion rings are comprised of an equal plurality of hingedly connected axial sections of a cylinder consisting of a whole cylinder, each cylindrical section being provided with means for introduction or withdrawal of a desired amount of fluid pressure into or from the plurality of bladder-like structures formed.

9. The apparatus of claim 1, wherein said flexible liner is comprised of a pourable high density polyurethane material.

10. The apparatus of claim 5, wherein said flexible liner is comprised of a pourable high density polyurethane material.

11. The apparatus of claim 2, wherein said friction sleeve is comprised of metal reinforced fiberglass base braking material.

12. The apparatus of claim 6, wherein said friction sleeve is comprised of metal reinforced fiberglass base braking material.

13. The apparatus of claim 1, wherein the mechanical structure of the internal sleeve is a plurality of axially disposed splines of generally rectangular cross-sectional area which project radially from the internal sleeve wherein said axially disposed splines are of sufficient depth that the internal sleeve and flexible liner will remain interfittingly engaged at maximum expected inward deflection of the flexible liner.

14. The apparatus of claim 5, wherein the mechanical structure of the internal sleeve is a plurality of axially disposed splines of generally rectangular cross-sectional area which project radially from the internal sleeve wherein said axially disposed splines are of sufficient depth that the internal sleeve and flexible liner will remain interfittingly engaged at maximum expected inward deflection of the flexible liner.

15. The apparatus of claim 1, wherein the mechanical structure of the internal sleeve is a plurality of cylindrically shaped pins which project radially from the internal sleeve wherein said axially disposed cylindrical shaped pins are of sufficient length that the internal sleeve and flexible liner will remain interfittingly engaged at maximum expected inward deflection of the flexible liner.

16. The apparatus of claim 5, wherein the mechanical structure of the internal sleeve is a plurality of cylindrically shaped pins which project radially from the internal sleeve wherein said axially disposed cylindrical shaped pins are of sufficient length that the internal sleeve and flexible liner will remain interfittingly engaged at maximum expected inward deflection of the flexible liner.

* * * * *